US008850768B2

(12) United States Patent
Hannig

(10) Patent No.: US 8,850,768 B2
(45) Date of Patent: Oct. 7, 2014

(54) FLOOR PANEL WITH SOFT/RESILIENT WEAR LAYER

(75) Inventor: Hans-Jurgen Hannig, Bergisch Gladbach (DE)

(73) Assignee: Akzenta Paneele + Profile GmbH, Kaiseresch (DE)

( * ) Notice: Subject to any disclaimer, the term of this patent is extended or adjusted under 35 U.S.C. 154(b) by 0 days.

(21) Appl. No.: 13/988,884

(22) PCT Filed: Nov. 22, 2011

(86) PCT No.: PCT/EP2011/070701

§ 371 (c)(1), (2), (4) Date: May 22, 2013

(87) PCT Pub. No.: WO2012/069485

PCT Pub. Date: May 31, 2012

(65) Prior Publication Data

US 2013/0243996 A1 Sep. 19, 2013

(30) Foreign Application Priority Data

Nov. 23, 2010 (DE) ..... 20 2010 015 754 U

(51) Int. Cl.
*E04F 15/22* (2006.01)
*E04F 15/16* (2006.01)

(52) U.S. Cl.
USPC ..... 52/403.1; 52/177; 52/592.1; 52/591.3

(58) Field of Classification Search
USPC ..... 52/506.01, 588.1, 591.3, 589.1, 314, 52/592.1, 591.1, 536, 538, 539, 578, 52/403.1, 393–394, 587.1, 384–389, 52/177–181, 316; 428/50, 192
See application file for complete search history.

(56) References Cited

U.S. PATENT DOCUMENTS

| | | | | |
|---|---|---|---|---|
| 7,584,583 | B2 * | 9/2009 | Bergelin et al. | 52/588.1 |
| 7,722,287 | B2 * | 5/2010 | Swank | 404/73 |
| 8,028,846 | B2 * | 10/2011 | Peota et al. | 211/187 |
| 2011/0131909 | A1 | 6/2011 | Hannig | |

FOREIGN PATENT DOCUMENTS

| | | | |
|---|---|---|---|
| DE | 102 01 087 | A1 | 7/2002 |
| DE | 20 2008 010 555 | U1 | 12/2009 |

(Continued)

OTHER PUBLICATIONS

International Search Report of PCT/EP2011/070701 dated Feb. 6, 2012.

*Primary Examiner* — Jeanette E. Chapman
(74) *Attorney, Agent, or Firm* — Lucas & Mercanti, LLP

(57) ABSTRACT

The invention relates to a floor panel comprising a carrier layer, a wear layer made of a soft/resilient material, and at least two opposite pairs of locking edges, where at least the locking edges of one pair are designed as form-fitting edges and in such a way that two floor panels can be connected by means of these formfitting edges, and where the form-fitting edges each display a horizontal locking surface which, in connected state, together counteract separation of the floor panels in a direction lying in the floor plane and perpendicular to the form-fitting edges, where each form-fitting edge displays a joint-sealing area in the area of the soft/resilient wear layer, and where the horizontal locking surfaces and the joint-sealing areas are coordinated in such a way that, in connected state of two floor panels, initial compression of the joint-sealing areas against each other can be produced and, as a result, a tightly sealed joint in the area of the soft/resilient wear layer.

5 Claims, 4 Drawing Sheets

(56) References Cited

FOREIGN PATENT DOCUMENTS

Figure 1:
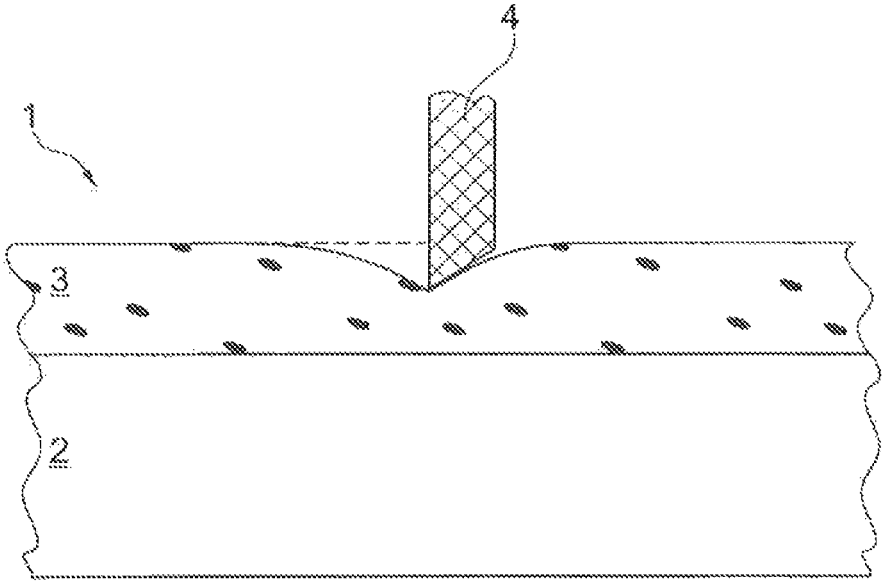

| | | | |
|---|---|---|---|
| EP | 1 634 696 | A1 | 3/2006 |
| JP | 2005098109 | A | 4/2005 |
| JP | 2009074255 | A | 4/2009 |
| WO | WO 97/47834 | A1 | 12/1997 |
| WO | WO 01/51733 | A1 | 7/2001 |

* cited by examiner

FLOOR PANEL WITH SOFT/RESILIENT WEAR LAYER

CROSS REFERENCE TO RELATED APPLICATION

This Application is a 371 of PCT/EP2011/070701 filed on Nov. 22, 2011, which claimed the priority of German Patent Application No. 20 2010015 754A filed on Nov. 23, 2010, both applications are incorporated herein by reference in their entirety.

The invention relates to a floor panel comprising a carrier layer, a wear layer made of a soft/resilient material, and at least two opposite pairs of locking edges, where at least the locking edges of one pair are designed as form-fitting edges and in such a way that two floor panels can be connected by means of these form-fitting edges, and where the form-fitting edges each display a horizontal locking surface which, in connected state, together counteract separation of the floor panels in a direction lying in the floor plane and perpendicular to the form-fitting edges.

Generic floor panels are known, whose wear layer is made of cork, linoleum or a plastic in order to create the required soft/resilient property. For the purpose of simple assembly, the floor panels display locking edges that can be connected in form-fitting fashion, these being suitable for glueless production of a floor covering.

Also known for production of a floor covering, apart from floor panels with a soft/resilient wear layer, are so-called laminate panels with harder wear surfaces. The hard wear layers are very thin in comparison with soft/resilient wear layers. They are likewise available in diverse embodiments suitable for glueless laying of a floor covering. All manufacturers refer to these laminate panels as "click laminate". The locking edges of click laminate are designed in such a way that they permit form-fitting, occasionally snap-in, connection. The term "click laminate" is nowadays asserting itself as a synonym for quick and simple production of a floor covering, and is also applied in the broadest sense to floor panels displaying a soft/resilient wear layer or a soft/resilient layer at some ether point within a floor panel comprising several layers.

The different embodiments of locking edges familiar from click laminate can generally also be provided on floor panels having a soft/resilient wear layer. In this context, however, attention has to be paid to particular effects that have an impact during production of the locking edges and during laying, i.e. when connecting complementary locking edges.

EP 1 634 696 A1 describes so-called floor covering elements, including a floor covering element with a carrier layer and a soft/resilient wear layer. This prior art acknowledges floor covering elements laid in floating fashion, as well as click laminate, where one panel snaps into the other. The teaching of EP 1 634 696 A1 refers to the layer structure of a floor covering element and says nothing about the design of the panel edges.

Cutting processes, such as sawing or milling, are often used to produce locking edges on floor panels. The soft/resilient wear layer is elastically deformed during cutting. For instance, when a circular saw blade plunges into a soft/resilient wear layer, the latter is dented by the feed motion of the circular saw blade. A milling cutter likewise dents the soft/resilient wear layer. In the region of the cutting point, some areas of the soft/resilient material are stretched, other areas being compressed. The elastic deformation is reversed once the cutting operation is completed. After reversal of the elastic deformation, the surfaces created in this way do not match the contour along which the cutting tool traveled.

The material behaviour of the soft/resilient wear layer makes it difficult to machine locking edges on floor panels in such a way that adjacent soft/resilient wear layers of connected floor panels contact each other smoothly, without any open joints being formed. If open joints do form, dirt can collect in them and moisture can penetrate between the locking edges.

The object of the invention is to propose a floor panel of the generic type indicated in the opening paragraph, that favours the production of floor coverings with a closed surface.

According to the invention, the object is solved in that each form-fitting edge displays a joint-sealing area in the area of the wear layer, and in that the horizontal locking surfaces and the joint-sealing areas are coordinated in such a way that, in connected state of two floor panels, initial compression of the joint-sealing areas against each other can be produced and, as a result, a tightly sealed joint in the area of the wear layer.

The joint-sealing areas are produced using cutting tools. They are selected and/or set for the cutting operation in such a way that the required contour of the joint-sealing area of the wear layer is obtained when the elastic deformation of the soft/resilient wear layer is reversed after the end of the cutting operation. The contour obtained in this way guarantees contact and initial compression of the joint-sealing areas in locked state of two floor panels.

The required contour of the joint-sealing area can be produced by a cutting tool displaying a corresponding geometry that takes into account the elastic deformation of the wear layer during the cutting operation. Alternatively, by setting the position of the cutting tool, appropriately, an influence can be exerted on the elastic deformation of the soft/resilient wear layer, such that the required contour of the joint-sealing area is obtained in the finished state, following reversal of the elastic deformation.

Favourably, at least one of the joint-sealing areas is designed as a projecting compression area.

The projecting compression area can form a sealing lip, which can be designed in such a way that it ends in a tip close to the top surface of the wear layer. The contour of the joint-sealing area of the wear layer is simply a surface inclined relative to the wear surface. This inclined surface, tapering to a tip towards the wear surface, is easy to manufacture.

The second joint-sealing area can be designed to be flat, or likewise as a projecting compression area with or without a sealing lip.

The joint-sealing area of the wear layer can be provided with an adhesive, at least on one of the form-fitting edges.

Expediently, the adhesive can be activated during laying of the floor panels.

A further benefit is seen as being that the adhesive displays two adhesive components.

The first adhesive component can be provided in the joint-sealing area of a first form-fitting edge of the floor panel, and the second adhesive component can be provided in the joint-sealing area of the opposite, second form-fitting edge of the floor panel.

Figure 2:
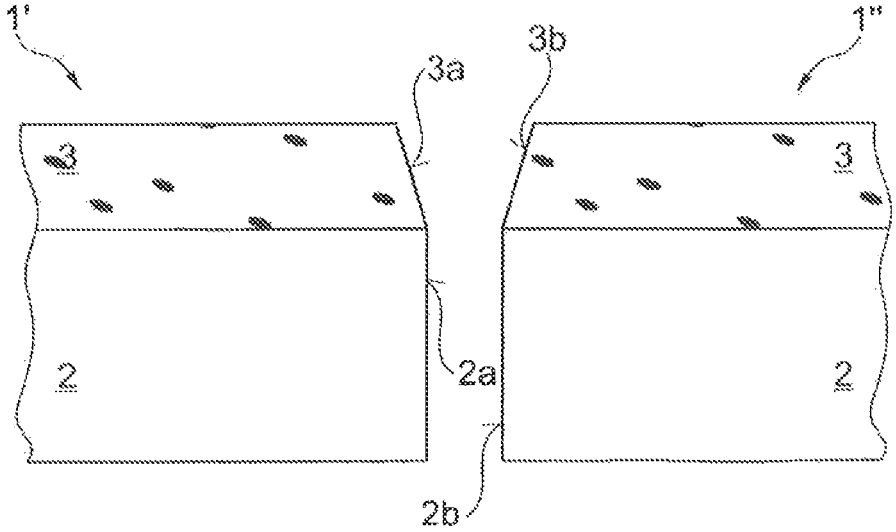
Figure 3:
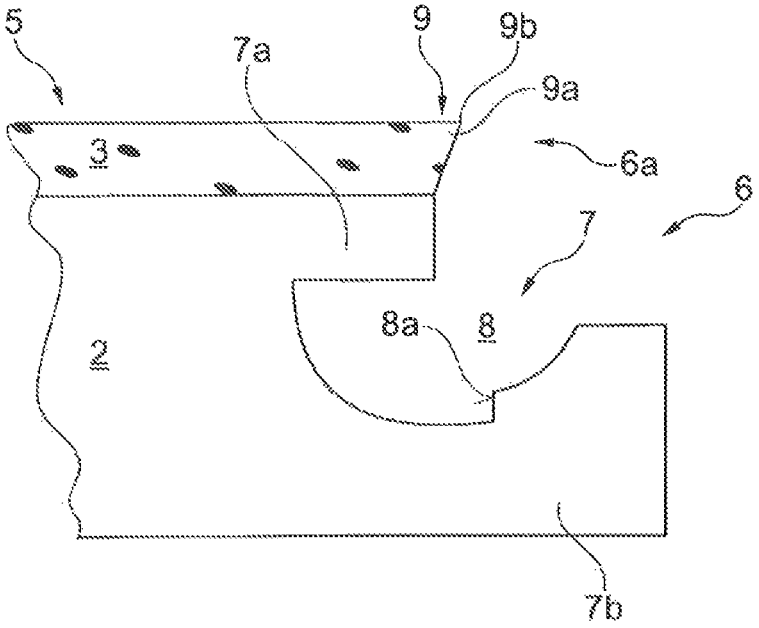
Figure 4:
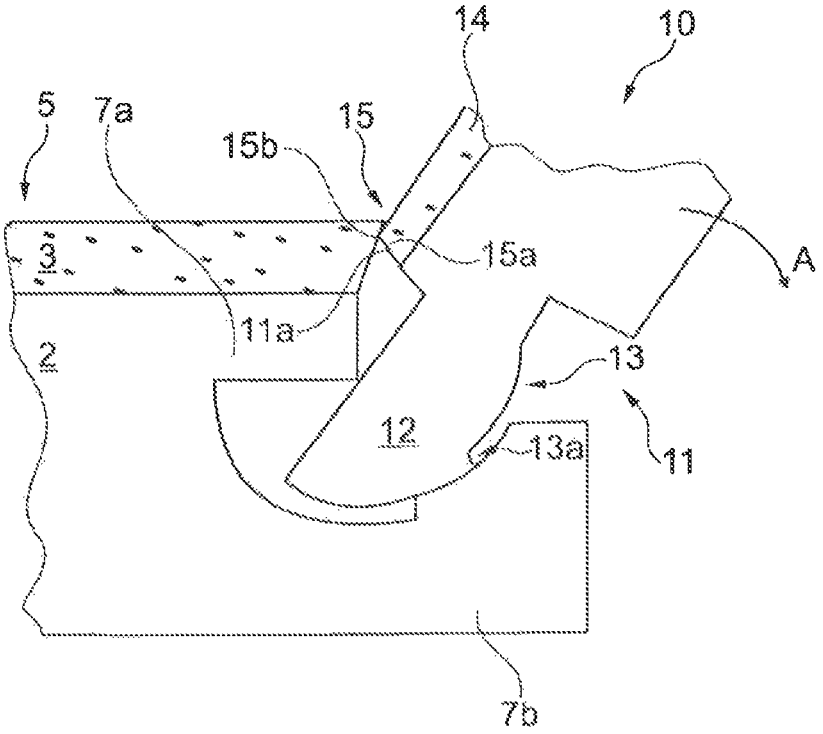
Figure 5:
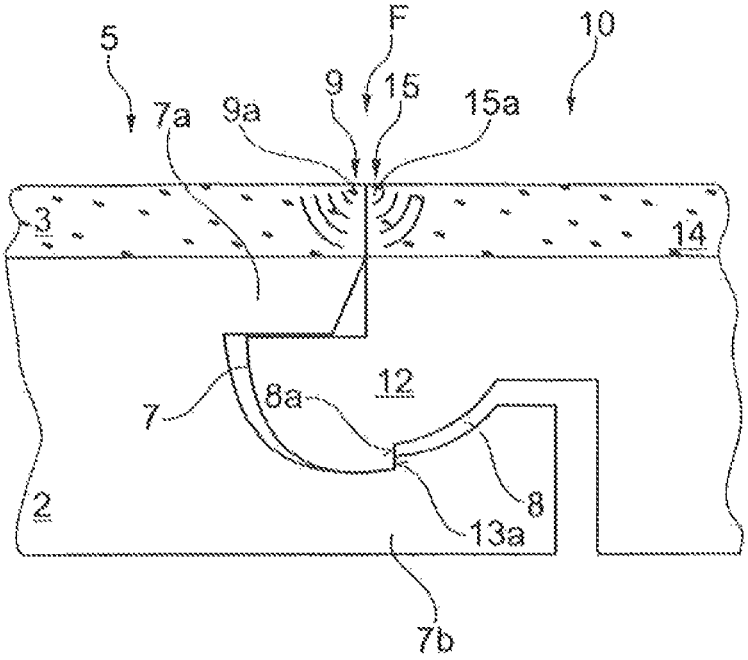
Figure 6:
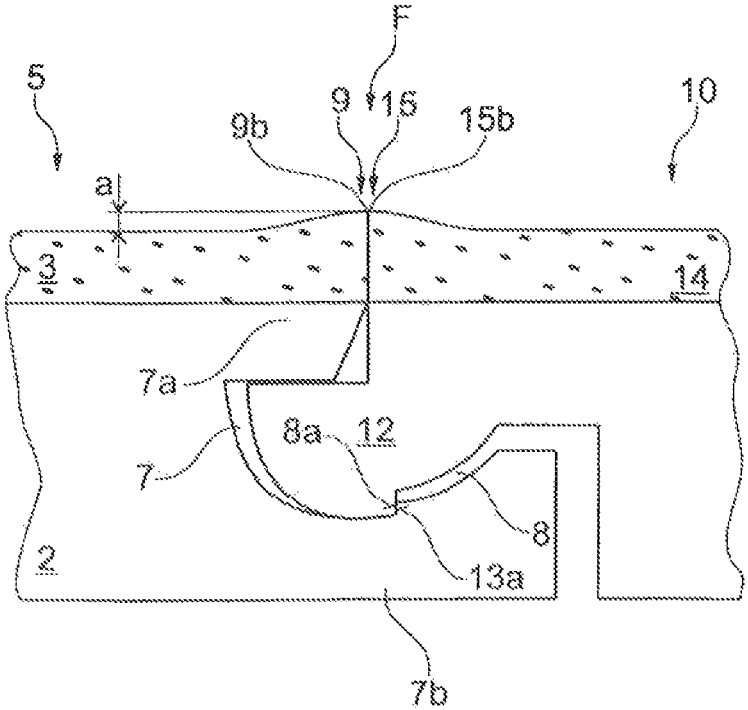
Figure 7:
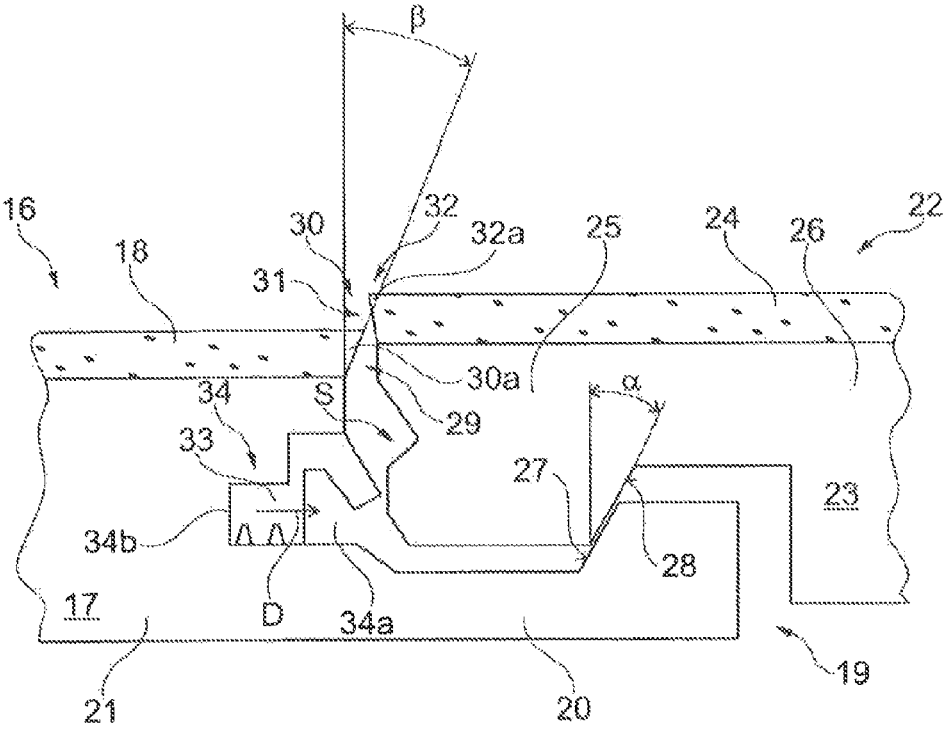
Figure 8:
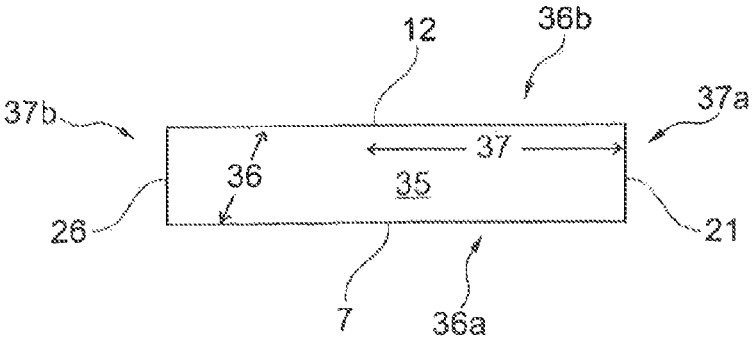

Exemplary embodiments of the invention are illustrated in a drawing and described in detail below on the basis of several Figures. The Figures show the following:

FIG. 1 The start of production of locking edges on floor panels displaying a soft/resilient wear layer, FIG. 2 Two panel edges produced by a parting cut, FIG. 3 A form-fitting edge with modified groove profile that displays a horizontal locking surface, FIG. 4 The form-fitting edge according to FIG. 3 and a complementary form-fitting edge during a rotary connecting movement, FIG. 5 The form-fitting edges according to FIG. 4 in connected or locked state, FIG. 6 An alternative embodiment of two form-fitting edges in connected or locked state, FIG. 7 Two form-fitting edges with hook profiles that can be hooked together by means of a vertical movement or movement component, FIG. 8 A top view of a floor panel with four panel edges and with a first pair of form-fitting edges on two opposite locking edges, and with a second pair of other form-fitting edges on the other two opposite locking edges.

FIGS. 1 and 2 show the start of production of locking edges on floor panels, namely the cutting of a larger panel 1 into individual panel sections 1' and 1", which are subsequently provided with locking edges and further processed into floor panels. Panel 1 displays a carrier layer 2 and, on it, a soft/resilient wear layer 3. FIGS. 1 and 2 illustrate the technical problem entailed by machining a panel 1 if the latter displays a soft/resilient wear layer 3.

FIG. 1 shows a saw blade 4 that cuts through panel 1. Saw blade 4 performs a cutting movement and a feed movement. The feed movement compresses soft/resilient wear layer 3. In the region of the cutting point, this compression causes wear layer 3 to be stretched in some areas and compressed in some areas.

Once saw blade 4 has cut through panel 1, as illustrated in FIG. 2, the temporary elastic deformation of soft/resilient wear layer 3 is reversed again. In the area of wear layer 3, the parting cut produces parting planes 3*a* and 3*b*, which are inclined relative to the plane in which the feed movement of saw blade 4 takes place. Parting planes 3*a* and 3*b* lie opposite each other in roughly wedge-shaped fashion.

In contrast, as can be seen in FIG. 2, parting planes 2*a* and 2*b* created in the area of carrier layer 2 lie parallel to each other and also parallel to the plane of the feed movement of saw blade 4.

FIG. 3 is a partial illustration of a floor panel 5. It displays a form-fitting edge 6, provided with a modified groove profile 7. Floor panel 5 displays a complementary form-fitting edge with modified tongue profile, although this has been omitted in the partial illustration in FIG. 3. A joint-sealing area 6*a* is formed in the region of soft/resilient wear layer 3. Floor panel 5 is shown in horizontal position in FIG. 3, illustration of the substrate being dispensed with.

Groove profile 7 displays an undercut 8 located in a horizontal direction, i.e. acting in the plane of floor panel(s) 5, by means of which plane separation of lying, connected floor panels perpendicularly to the form-fitting edge is counteracted. Upper groove wall 7*a* is shorter than lower groove wall 7*b*. Groove wall 7*b* displays a horizontal locking surface 8*a* for the purpose of horizontal locking. Joint-sealing area 6*a* of soft/resilient wear layer 3 is provided with a projecting compression area 9 that forms a sealing lip 9*a*. In this embodiment, sealing lip 9*a* has a tip 9*b* projecting distally from the panel body. Tip 9*b* is located on the surface of wear layer 3, which forms the wear surface of floor panel 5.

A second, similar floor panel 10 is added in FIG. 4. The illustration shows the complementary form-fitting edge 11 of second floor panel 10, which is provided with the modified tongue profile 12. In FIG. 4, second floor panel 10 is held at an angle to the first, lying floor panel 5, such that its tongue profile 12 reaches into groove profile 7 of first floor panel 5. Tongue profile 12 displays an undercut 13 and is provided with a horizontal locking surface 13*a* that, in locked state of the two floor panels 5 and 10, is in contact with horizontal locking surface 8*a* of groove profile 7 of the other floor panel 5. Form-fitting edge 11 likewise displays a joint-sealing area 11*a* in the area of a soft/resilient wear layer 14. Joint-sealing area 11*a* displays a compression area 15, which forms a sealing lip 15*a*. This is likewise provided with a tip 15*b*, like sealing lip 9*a* of groove profile 7.

The locked state is achieved by means of a rotary connecting movement, for which second floor panel 10 is swung downwards in the direction of arrow A into the plane of first floor panel 5. Complementary form-fitting edges 6 and 11 engage as a result, locking floor panels 5 and 10 together in form-fitting fashion.

The locked state is illustrated in the following FIGS. 5 and 6. According to FIG. 5, a form-fitting lock has been created, where horizontal locking surface 13*a* of tongue profile 12 is in contact with horizontal locking surface 8*a* of groove profile 7. It can moreover be seen that sealing lip 9*a* of joint-sealing area 6*a* is in contact with sealing lip 15*a* of joint-sealing area 11*a*. The line symbols ((( ))) in FIG. 5 indicate that initial compression of joint-sealing areas 6*a*/11*a* is present, this generating compression of the soft/resilient material of wear layer 3 or 14 in the area of joint F. According to FIG. 5, sealing laps 9*a*/15*a* are designed in such a way that the compression is slight enough not to result in bulging of the floor surface in the area of joint F.

FIG. 6 shows an alternative embodiment, where sealing lips 9*a*/15*a* are designed in such a way that the initial compression is such that it brings about slight bulging a of the floor surface in the area of joint F. If this bulging a is kept slight, it can advantageously serve as an indicator of the presence of initial compression. A high bulge, however, is to be avoided, since the bulging joint areas would wear too rapidly.

FIG. 7 is a partial illustration of two similar floor panels. Floor panel 16 displays a carrier layer 17 and a soft/resilient wear layer 18. The part shown is only its locking edge 19. The opposite, complementary locking edge of floor panel 16 has been omitted. Locking edge 19 is designed as form-fitting edge 20 and displays a lower hook profile 21. The complementary locking edge (not shown) of floor panel 16 corresponds to that of the illustrated second floor panel 22. The latter displays a carrier layer 23 and a soft/resilient wear layer 24. The part shown here is form-fitting edge 25, which displays an upper hook profile 26.

In hooked state, lower hook profile 21 is covered by upper hook profile 26 of floor panel 22.

Hook profiles 21 and 26 can be hooked together by means of a vertical movement or by means of a vertical movement component. Vertical means a movement component perpendicular to the panel plane. Lower hook profile 21 displays a horizontal locking surface 27, and upper hook profile 26 is provided with a horizontal locking surface 28. In connected state of the two floor panels 16 and 22, horizontal locking surfaces 27 and 28 are in contact and thus counteract separation of the two floor panels 16 and 22 in a direction lying in the floor plans and perpendicular to form-fitting edges 20/25.

On soft/resilient wear layer 18, form-fitting edge 20 displays a joint-sealing area 29, designed as a compression area 30. Compression area 30 forms a sealing lip 30*a*. Form-fitting edge 25 of floor panel 22 likewise displays a joint-sealing area 31, which is designed as a compression area 32 and forms a sealing lip 32*a*. In hooked state of hook profiles 21/26, sealing lips 30*a*/32*a* are pressed against each other and compressed, thereby producing a tightly sealed joint F.

According to FIG. 7, horizontal locking surface 27 of lower hook profile 21 is not arranged perpendicularly to the panel surface, but tilted from the perpendicular by an angle α, i.e. tilted perpendicularly to the panel plane. Horizontal locking surface 28 of upper hook profile 26 is parallel to horizontal locking surface 27, i.e. tilted from the perpendicular by the same angle α, meaning that the two horizontal locking surfaces rest on each other when in hooked state.

Sealing lip 30*a* of floor panel 16 is tilted from the perpendicular by angle β. The same applies to settling lip 32*a*, which is arranged symmetrically to sealing lip 30*a*.

The larger angle α is, the more gently sealing lips 30*a*/32*a* can be brought into contact. Values in the range from 5° to 45° are preferred for angle α, and values in the range from 1° to 5° for angle β. The horizontal locking effect is best if the lower limit of 5° is selected for angle α. In this case, however, the sealing lips are more severely deformed during the connecting movement than if a larger angle α is selected. This is because a larger angle α creates more space for the connecting movement. If more space is available for the connecting movement, sealing lips 30*a*/32*a* rub less strongly against each other and the connecting movement is more gentle. It has proven to be a favourable compromise if an angle of α=16° is combined with an angle of β=2°.

A separate locking element 33 is provided for locking perpendicularly to the panel plane. Separate locking element 33 is accommodated in a groove 34 that is open in the distal direction. The distal direction is indicated by arrow D. Groove base 31*b* is arranged proximally in relation to its groove opening 34*a*. Groove 34 extends into carrier layer 17 of floor panel 16. The complementary form-fitting edge of floor panel 16 is not shown. However, it corresponds to form-fitting edge 25 with upper hook profile 26, shown on floor panel 22. The upper hook profile displays a locking groove S for separate locking element 33. Locking groove S is designed in such a way that, in hooked state, separate locking element 33 of the hook profiles is located partly in groove 34 and partly in locking groove S, or, after hooking of the hook profiles, can at least be inserted in such a way that it is located partly in groove 34 and partly in locking groove S.

Apart from the functional design shown in FIG. 7, the separate locking element can also be of different other designs. It can be of springy design and automatically snap into a locking groove. Alternatively, the separate locking element can be designed in such a way that it is only moved into the locking groove by lateral sliding within the accommodating groove, thus creating a locking effect. This lateral sliding can take place with or without elastic deformation. The separate locking element can be designed in such a way that it can be applied before the hook profiles are hooked together, as illustrated in FIG. 7, for example. Alternatively, the separate locking element can be designed in such a way that it can be fitted after the hook profiles have been hooked together. Examples of separate locking elements suitable for the invention are indicated in the following publications, for example: EP 1 415 056, EP 1 420 125, DE 20 2006 019 869, EP 2 049 749, EP 2 000 610, WO 01/51732 and WO 2008/004960.

A example of a floor panel 35 is illustrated schematically in FIG. 8. Floor panel 35 displays a first pair 36 of opposite locking edges and a second pair 37 of opposite locking edges. The locking edges of first pair 36 differ from the locking edges of second pair 37.

First pair 36 displays a form-fitting edge 36*a* with a groove profile 7 (according to FIG. 3) and a form-fitting edge 36*b* with a tongue profile 12 (according to FIG. 5).

The second pair 37 with locking edges displays a form-fitting edge 37*a* with a lower hook profile 21 (according to FIG. 7) and a form-fitting edge 37*b* with an upper hook profile 26 (according to FIG. 7). Lower hook profile 21 is provided with a separate locking element 33.

When attaching a new floor panel 35 to a previously started floor covering, i.e. to a floor covering displaying a previous row of floor panels 35 and at least one floor panel 35 in the same row, form-fitting edge 36*b* can be connected by swinging down the new floor panel 35 (according to FIG. 5), in which context form-fitting edge 37*b* of new floor panel 35 is simultaneously locked with a form-fitting edge 37*a* of the floor panel already present in the same panel row.

LIST OF REFERENCE NUMBERS

1 Panel
1' Panel section
1" Panel section
2 Carrier layer
2*a* Parting plane
2*b* Parting plane
3 Soft/resilient wear layer
3*a* Parting plane
3*b* Parting plane
4 Saw blade
5 Floor panel
6 Form-fitting edge
6*a* Joint-sealing area
7 Groove profile
7*a* Upper groove wall
7*b* Lower groove wall
8 Undercut
8*a* Horizontal locking surface
9 Compression area
9*a* Sealing lip
9*b* Tip
10 Floor panel
11 Form-fitting edge
11*a* Joint-sealing area
12 Tongue profile
13 Undercut
13*a* Horizontal locking surface
14 Soft/resilient wear layer
15 Compression area
15*a* Sealing lip
15*b* Tip
16 Floor panel
17 Carrier layer
18 Soft/resilient wear layer
19 Locking edge
20 Form-fitting edge
21 Lower hook profile
22 Floor panel
23 Carrier layer
24 Soft/resilient wear layer
25 Form-fitting edge
26 Upper hook profile
27 Horizontal locking surface
28 Horizontal locking surface
29 Joint-sealing area
30 Compression area
30*a* Sealing lip
31 Joint-sealing area
32 Compression area
32*a* Sealing lip
33 Separate locking element
34 Groove
34*a* Groove opening
34*b* Groove base

35 Floor panel
36 First pair of locking edges
36*a* Form-fitting edge
36*b* Form-fitting edge
37 Second pair of locking edges
37*a* Form-fitting edge
37*b* Form-fitting edge

The invention claimed is:

1. Floor panel comprising:

a carrier layer, a wear layer made of a soft/resilient material, and at least two opposite pairs of locking edges, where at least the locking edges of one pair are designed as form-fitting edges and in such a way that two floor panels can be connected by means of these form-fitting edges, and where the form-fitting edges each display a horizontal locking surface which, in connected state, together counteract separation of the floor panels in a direction lying in the floor plane and perpendicular to the form-fitting edges, wherein each form fitting edge displays a joint-sealing area in the area of the soft/resilient wear layer, wherein at least one of the joint-sealing areas is designed as a projecting compression area that tapers toward a tip proximate a top of the wear layer, and wherein the horizontal locking surfaces and the joint-sealing areas are coordinated in such a way that, in connected state of two floor panels, initial compression of the joint-sealing areas against each other can be produced and, as a result, a tightly sealed joint in the area of the soft/resilient wear layer.

2. Floor panel according to claim 1, further comprising adhesive disposed on one of the form-fitting edges.

3. Floor panel according to claim 2, wherein the adhesive can be activated during laying of the floor panels.

4. Floor panel according to claim 3, wherein the adhesive displays two adhesive components.

5. Floor panel according to claim 4, wherein the first adhesive component is provided in the joint-sealing area of a first form-fitting edge of the floor panel, and in that the second adhesive component is provided in the joint-sealing area of the opposite, second form-fitting edge of the floor panel.

* * * * *